US005965008A

United States Patent [19]

Greaney et al.

[11] Patent Number: 5,965,008

[45] **Date of Patent: *Oct. 12, 1999**

[54] METHOD FOR ANODICALLY DECREASING CONRADSON CARBON CONTENT OF PETROLEUM STREAMS

[75] Inventors: Mark Alan Greaney, Upper Black Eddy, Pa.; Michael Charles Kerby, Baton Rouge, La.

[73] Assignee: Exxon Research and Engineering Company, Florham Park, N.J.

[ * ] Notice: This patent is subject to a terminal disclaimer.

[21] Appl. No.: 08/771,108

[22] Filed: Dec. 20, 1996

[51] Int. Cl.[6] ..... C25B 1/00

[52] U.S. Cl. ..... 205/696; 204/514; 204/559; 204/567

[58] Field of Search ..... 205/696; 204/514, 204/559, 567

[56] References Cited

U.S. PATENT DOCUMENTS

| | | | |
|---|---|---|---|
| 3,401,101 | 9/1968 | Keller, Jr. | 204/136 |
| 3,915,819 | 10/1975 | Bell et al. | 204/136 |
| 4,187,156 | 2/1980 | Coleman et al. | 204/73 R |
| 5,514,252 | 5/1996 | Kerby, Jr. et al. | 205/696 |

OTHER PUBLICATIONS

ASTM Designation: D 4530–85, "Standard Test Method for Micro Carbon Residue of Petroleum Products", pp. 441–445, (No Date).

ASTM Designation: D 189–88 (IP Designation: 13/82), "Standard Test Method for Conradson Carbon Residue of Petroleum Products", pp. 95–101, (No Date).

Danly, D. E., "Development and Commercialization of the Monsanto Electrochemical Adiponitrile Process" (Chapter 7) in Electrosynthesis From Laboratory To Pilot Production (1990), pp. 147–164 (No Month).

*Primary Examiner*—Arun S. Phasge
*Attorney, Agent, or Firm*—Linda M. Scuorzo

[57] ABSTRACT

The present invention provides for a method for decreasing the Conradson carbon content of petroleum streams by forming a mixture of the petroleum stream and an essentially aqueous electrolysis medium, and passing an electric current through the mixture at an anodic voltage and pH sufficient to produce a petroleum fraction having decreased Conradson carbon content. The anodic voltage is from +0.5 to +1.5V vs. SCE. Preferably the pH is acidic. The invention provides a method for enhancing the value of petroleum feeds that traditionally have limited use in refineries.

10 Claims, No Drawings

METHOD FOR ANODICALLY DECREASING CONRADSON CARBON CONTENT OF PETROLEUM STREAMS

FIELD OF THE INVENTION

The present invention relates to a method for electrochemically decreasing the Conradson Carbon content of refinery feedstreams.

BACKGROUND OF THE INVENTION

Conradson carbon ("Concarbon") number or content is a measure of the characteristic tendency or propensity of a petroleum feedstream to form coke during processing. Feedstreams having a lower Concarbon number are more economically desirable as refinery feeds than feedstreams having a higher concarbon number. For example U.S. Pat. No. 5,514,252 discloses reductive electrochemical treatment of refinery streams which occurs at specified cathodic potentials. It is, therefore, desirable to develop processes for reducing the Concarbon number of feedstreams. Applicants have developed such a process.

SUMMARY OF THE INVENTION

A process for decreasing the Conradson content of a petroleum stream, comprising: passing an electric current through a mixture of a petroleum stream having a Conradson carbon content and an aqueous electrolysis medium at a sufficient anodic potential and at a pH sufficient to oxidatively decrease the Conradson carbon content of the petroleum stream. The electrolysis medium contains an electrolyte which is water soluble. Preferably the pH is less than 7.

The present invention may suitably comprise, consist or consist essentially of the described elements and may be practiced in the absence an element not disclosed.

DETAILED DESCRIPTION OF THE INVENTION

The present invention provides a method for oxidatively decreasing the Conradson carbon ("Concarbon") number of a petroleum fraction by subjecting a solution (typically oil in water dispersion) or mixture of a Conradson carbon containing petroleum fraction or phase (also referred to herein as a stream or feed) and an aqueous electrolysis medium to an electric current at a pH and anodic voltage and for a time sufficient to decrease the Conradson carbon number or content of the petroleum stream. The petroleum stream and aqueous electrolysis medium are contacted under conditions to result in passing of an anodic current therethrough. Thus electrolytic oxidation at the anode of the electrolytic cell yields treated petroleum fractions or streams having a decreased Conradson carbon number from the starting material.

Conradson carbon number correlates with the coke residue forming potential or propensity of petroleum streams. Petroleum streams having a high coke make typically have a deleterious effect on a number of petroleum refinery processes, such as fluid catalytic cracking, hydrotreating, coking, visbreaking, deasphalting and pipestill operations. In addition, coke is currently the lowest value refinery product, and thus generation of large quantities is not economically desirable. The higher the Concarbon number the greater the number or size of the refinery units typically needed to process the resulting coke residue. Therefore, decreasing the Conradson carbon content or number of a petroleum stream or fraction can decrease or eliminate the need to treat or dispose of the resulting coke.

A wide variety of petroleum streams, including distillates thereof may be treated according to the process of the present invention to produce petroleum hydrocarbon fractions having a decreased Conradson carbon number. The starting feedstocks are hydrocarbonaceous petroleum streams or fractions having a Conradson carbon number or content, typically of at least about 0.1% by weight, and usually at least about 5% by weight. The process is applicable to distillates and other Conradson carbon containing product feeds resulting from various refinery processes, but is particularly effective when employed to treat heavy hydrocarbon feeds, e.g., those containing residual oils. Advantageously, therefore, the process of the present invention is utilized for the treatment of whole or topped crude oils and residua having a Conradson carbon content. These include heavy oils, such as atmospheric residum (boiling above about 650° F., 343° C.) and vacuum residum (boiling above about 1050° F., 566° C.), heavy crudes, processed resides (bottoms) i.e., catalytic cracker bottoms, tars, e.g. steam cracker tars, distillation resides, deasphalted oils and resins and coker oils. Virgin crude oils obtained from any area of the world such as the Middle East as well as heavy gas oils, shale oils, tar sands or syncrude derived from tar sands, distillation resids, coal oils, asphaltenes and other heavy petroleum fractions and distillates thereof can be treated by the process of this invention.

The petroleum fraction contacted with the aqueous electrolysis medium should be liquid or fluid at process conditions. This may be accomplished by heating the material or by treatment with a suitable solvent as needed. This assists in maintaining the mixture of the Conradson carbon-containing petroleum fraction or stream and aqueous electrolysis medium in a fluid form to allow passage of an anodic current. Current densities of 1 $mA/cm^2$ of anode surface area or greater are suitable.

Preferably droplets should be of sufficient size to enable the Conradson carbon-containing components or species to achieve intimate contact with the aqueous electrolysis medium. Droplet size particles of about 0.1 micron to 1.0 mm, for example, are suitable. Contacting is typically accomplished by intimate mixing of the petroleum stream and the aqueous electrolysis medium to form a mixture or an oil-in-water dispersion, for example using a stirred batch reactor or turbulence promoters in flowing cells.

Desirably the process should be carried out for a time and at conditions within the ranges disclosed sufficient to achieve a decrease, preferably a maximum decrease, in the Conradson carbon number of the petroleum stream. Decreases of 3% or higher can be achieved, depending on the starting feed.

Reaction temperatures will vary with the particular petroleum stream due to its viscosity, type of electrolyte and its pH. However, temperatures may suitably range from about ambient to about 700° F. (371° C.), preferably from 100° F. (38° C.) to 300° F. (149° C.), and pressures of from 0 atm (0 kPa) to 210 atm (21,200 kPa), preferably 1 atm (101 kPa) to 3 atm (303 kPa). Within the process conditions disclosed a liquid or fluid phase is maintained.

The electrolysis medium should desirably contain an electrolyte that dissolves or dissociates in water to produce electrically conducting ions at the required pH, but that does not undergo redox in the range of applied potentials used. Organic electrolytes include quaternary carbyl and hydrocarbyl onium salts e.g., alkylammonium hydroxides and tetrabutyl ammonium toluene sulfonate and inorganic acids. Inorganic electrolytes include acids and under appropriate conditions NaOH, KOH and other inorganic salts. Suitable onium ions include mono-and bis-phosphonium, sulfonium and ammonium, preferably ammonium ions. Carbyl and hydrocarbyl moieties are preferably alkyl. Optionally, additives known in the art to enhance performance of the electrodes or the system may be added such as surfactants, detergents, depolarizing agents and emulsifying agents. With organic electrolytes, length and degree of branching of the carbyl or hydrocarbyl moieties influences the degree of oil or water solubility. The concentration of electrolyte in the electrolysis medium should be sufficient to generate an electrically conducting solution in the presence of the petroleum component. Typically a concentration of electrolyte in the aqueous electrolysis medium is 1–50 wt %, preferably 5–25 wt % is suitable.

Within the process conditions disclosed the pH of the aqueous electrolysis medium can be varied. However, the pH should be sufficient to maintain an anodic voltage within the disclosed range. The treatment can be carried out at any suitable pH within that range, preferably at an acidic pH (pH less than 7).

It is possible to carry out the process either in air or under inert atmosphere. A benefit to the present invention is that the process may be operated under ambient temperature and atmospheric pressure, although higher temperature and pressures also may be used as needed.

The process is carried out in an electrochemical cell by electrolytic, i.e., in a non-electrostatic, mode, as passage of electric current through the mixture or dispersion is required (e.g., relatively low voltage, high current). The cell may be either divided or undivided. Such systems include stirred batch or flow through reactors. The foregoing may be purchased commercially or made using technology known in the art. Suitable electrodes are known in the art.

Electrodes having a high oxygen overpotential are suitable as anodes for the oxidative treatment of the Conradson carbon containing stream or fraction, e.g., platinum, lead and carbon. Included as suitable three dimensional electrodes are carbon or metallic foams. The anodic voltage should be in a range of +0.5 to +1.5V versus Saturated Calomel Electrode (SCE), based on the characteristics of the particular petroleum fraction. While direct current is typically used, electrode performance may be enhanced using alternating current or other voltage/current waveforms.

The Conradson carbon con tent was determined using the microcarbon residue (MCR) method, ASTM D-4530-85. According to ASTM D 4530-85, MCR is equivalent to Conradson carbon.

What is claimed is:

1. A process for decreasing the Conradson content of a petroleum stream, comprising: passing an electric current through a mixture of a petroleum stream having a Conradson carbon content and an aqueous electrolysis medium at a sufficient anodic potential and at a pH sufficient to oxidatively decrease the Conradson carbon content of the petroleum stream.

2. The process of claim 1 wherein the Conradson carbon content is at least about 0.1%.

3. The process of claim 1 wherein the anodic potential is from +0.5 to +1.5V vs. SCE.

4. The process of claim 1 wherein the aqueous electrolysis medium contains an electrolyte selected from the group consisting of inorganic salts, organic salts, thereof inorganic acids, organic acids and mixtures thereof.

5. The process of claim 1 wherein the petroleum stream is selected from the group consisting of crude oils, distillation resids, coker oils, bitumen, catalytic cracker bottoms, distillation resids, steam cracker tars, deasphalted oils, visbreaker bottoms, residfiner products.

6. The process of claim 1 wherein the pH is from less than 7.

7. The process of claim 1 wherein the pressure is from about 0 atm (0 kPa) to about 210 atm (21,200 kPa).

8. The process of claim 1 wherein the temperature is up to 700° F. (371°).

9. The process of claim 1 wherein the concentration of the electrolyte in the aqueous electrolysis medium is from 1 to 50 wt %.

10. The process of claim 1 wherein the mixture is an oil in water dispersion.

* * * * *